United States Patent [19]

Tate et al.

[11] Patent Number: 4,801,372

[45] Date of Patent: Jan. 31, 1989

[54] OPTICALLY ANISOTROPIC PITCH

[75] Inventors: Kazuhito Tate; Hajime Yoshida; Teruhiko Sasaki, all of Kanagawa, Japan

[73] Assignee: Mitsubishi Oil Co., Ltd., Tokyo, Japan

[21] Appl. No.: 914,426

[22] Filed: Oct. 2, 1986

[30] Foreign Application Priority Data

Oct. 2, 1985 [JP] Japan ..... 60-218079

[51] Int. Cl.[4] ..... C10C 3/06; D01F 9/20

[52] U.S. Cl. ..... 208/22; 208/39; 208/40; 208/44; 264/29.2; 423/447.4; 528/247; 585/11; 585/426

[58] Field of Search ..... 208/44, 22, 39, ; 423/447.1, 447.4

[56] References Cited

U.S. PATENT DOCUMENTS

| | | | |
|---|---|---|---|
| 3,607,672 | 9/1971 | Schmitt | 423/447.4 |
| 3,709,863 | 1/1973 | White et al. | 423/447.1 |
| 3,718,574 | 2/1973 | Traki et al. | 423/447.4 |
| 3,769,249 | 10/1973 | Bilow | 260/28 |
| 3,784,679 | 1/1974 | Chich | 423/447.1 |
| 3,928,544 | 12/1975 | Yokota et al. | 423/447.4 |
| 4,020,145 | 4/1977 | Soehngen et al. | 423/447.4 |
| 4,131,644 | 12/1978 | Nagasaka et al. | 423/447.2 |
| 4,146,576 | 3/1979 | Wyss | 423/447.4 |
| 4,152,482 | 5/1979 | Reynolds et al. | 423/447.2 |
| 4,336,022 | 6/1982 | Lynch et al. | 423/447.2 |
| 4,402,928 | 9/1983 | Lewis et al. | 208/22 |
| 4,412,059 | 10/1983 | Krigbaum et al. | 208/22 |
| 4,427,530 | 1/1984 | Dickakian | 423/447.4 |
| 4,429,172 | 1/1984 | Zellerhoffer et al. | 208/22 |
| 4,431,512 | 2/1984 | Dickakian | 423/447.4 |
| 4,431,623 | 2/1984 | Fug | 208/44 |
| 4,443,324 | 4/1984 | Diefendorf et al. | 208/22 |
| 4,448,670 | 5/1984 | Dickakian | 423/447.4 |
| 4,457,828 | 7/1984 | Lewis | 208/39 |
| 4,548,703 | 10/1985 | Dickakian | 208/22 |
| 4,589,974 | 5/1986 | Izumi | 208/22 |
| 4,670,129 | 6/1987 | Tate et al. | 208/22 |

FOREIGN PATENT DOCUMENTS

| | | | |
|---|---|---|---|
| 1356568 | 6/1974 | United Kingdom | 423/447.1 |
| 0097046 | 12/1983 | United Kingdom | 423/447.1 |

*Primary Examiner*—Curtis R. Davis
*Assistant Examiner*—Helane Myers
*Attorney, Agent, or Firm*—Sughrue, Mion, Zinn, Macpeak & Seas

[57] ABSTRACT

A novel optically anisotropic pitch is provided which is produced by thermal modification of a polymer having a structure of an alkylbenzene and a condensed aromatic compound with two to four fused rings bonded to each other via a methylene group.

In preferred embodiments, the optical anisotropy is 80% or more. As the alkylbenzene there may be used xylene, trimethylbenzene or tetramethylbenzene. As the condensed aromatic compound with two to four fused rings, there may be used naphthalene, anthracene, phenanthrene, or naphthacene. The polymer starting material may be obtained by the reaction of a xylene formalin resin, mesitylene formalin resin or alkylbenzene and a condensed aromatic compound with two to four fused rings in the presence of a protonic acid as a catalyst.

7 Claims, No Drawings

OPTICALLY ANISOTROPIC PITCH

FIELD OF THE INVENTION

The present invention relates to a pitch which has excellent properties as a raw material for production of high strength and high elasticity carbon fibers (high performance carbon fibers) and other carbon materials. More particularly, the present invention relates to an optically anisotropic pitch which shows high strength when molded, said pitch being obtained by thermal modification of a polymer which is composed of an alkylbenzene and a condensed aromatic compound with two to four fused rings bonded together via a methylene group.

BACKGROUND OF THE INVENTION

In general, carbon fibers are industrially produced by using rayon, PAN (polyacrylonitrile) and a pitch as raw materials. However, PAN is disadvantageous in that it is expensive and the carbonization yield is low. In this respect, pitches are cheap and thus economically attractive. However, low cost carbon fibers produced from isotropic pitches are poor in orientation and thus show low strength. Therefore, these pitches cannot provide a high performance fiber. By contrast, carbon fibers produced from optically anisotropic pitches which are called mesophase pitches have a highly oriented structure in which carbon crystallites preferentially align parallel to the fiber axis and thus have excellent mechanical characteristics, that is, high strength and a high modulus of elasticity. Extensive studies have been made to produce mesophase pitches as raw pitches for high performance carbon fibers from petroleum catalytic cracking residual oil, naphtha tar pitch, or coal tar pitch. However, a raw pitch thread obtained by melt-spinning of a pitch or an infusibilized fiber obtained merely by infusibilization of such a raw pitch thread is as extremely weak as 200 to 400 kg/cm$^2$ in fiber strength and 0.5% in elongation and thus is subject to breaking due to bending, fretting, or contact against the surface of heating vessel thereof. In this respect, such a pitch fiber is rather different from synthetic fiber such as PAN. This weak fiber strength impedes the production of pitch carbon fibers. Various attempts have been made to try to eliminate these defects of pitch carbon fibers. Especially, many approaches have been done in vain for improving the strength of a raw pitch thread.

Furthermore, these starting materials such as coal tar, naphtha tar, and residual oil from fluid catalytic cracking of a petroleum fraction contain free carbon or other inorganic materials such as catalyst powder which will become ash content. These materials impede spinning of the pitch. Furthermore, raw pitch threads or carbon fibers containing these finely divided particles have defects which cause low strength. Various approaches have been proposed to remove these undesirable particles. However, these approaches are not sufficient to remove fine particles such as submicron particles. Thus, these still remain room for improvement of pitches.

SUMMARY OF THE INVENTION

An object of the present invention is to provide an optically anisotropic pitch which is produced from a compound having a specified chemical structure as a starting material and which can be spun into raw threads having a much higher strength than the above-described mesophase pitch in an easy and stable manner.

The object of the present invention is accomplished by an optically anisotropic pitch which shows high strength when molded, said pitch being obtained by thermal modification of a polymer which is composed of an alkylbenzene and a condensed aromatic compound with two to four fused rings bonded together via a methylene group.

DETAILED DESCRIPTION OF THE INVENTION

The term "optical anisotropy" as used herein indicates an area where a light brightness is observed when a cross section of a pitch clump solidified at near room temperature is polished and examined under a crossed Nicol of a reflection type polarization microscope. The proportion of an optically anisotropic phase is determined based on such an area and indicated in percentage (%). "Toluene-insoluble content" and "quinoline-insoluble content" are determined by the methods specified in JIS-K-2425. "Softening point" indicates a temperature at which a pitch powder is observed to begin to deform when raised in temperature at a rate of 10° C./min in a nitrogen atmosphere by means of a hot stage type microscope.

The present invention provides a novel anisotropic pitch which is produced from a compound which has rarely been utilized as a starting material and which can be spun into raw threads having a much higher strength than the known mesophase pitch in an easy and stable manner.

In order to prepare such a pitch, it is necessary to carry out the preparation using a raw material having a specified chemical structure under sufficiently controlled conditions. As such a raw material there is used a polymer having a structure that an alkylbenzene and a condensed aromatic compound with two to four fused rings are bonded to each other via a methylene group. Polymer of the present invention can be obtained by polymerizing an alkylbenzene and a condensed aromatic compound with two to four fused rings in the presence of protonic acid catalyst such as a sulfuric acid, a phosphoric acid, a perchloric acid or a paratoluenesulfonic acid. A mixing ratio of an alkylbenzene on a condensed aromatic compound is 0.5 to 2 by weight and that of aldehyde is 1 to 2 by weight. Formaldehyde or acetaldehyde is preferred as aldehyde and they can be used in any form such as paraformaldehyde, trioxane and paraldehyde. The reaction mixture is polymerized at 80° to 150° C. for 1 to 5 hours with agitation. Then, polymer is obtained after the protonic acid is washed away and light fraction is, if necessary, removed by distillation.

The conventional xylene formalin resin or mesitylene formalin resin is also polymerized with a condensed aromatic compound with two to four fused rings as a substitute for an alkylbenzene and aldehyde. In this case a resin which has ether bond in its structure is more reactive on condensed aromatic compounds. Therefore, oxygen content of both resins is preferred to be 8 to 16 wt%.

An alkylbenzene which is substituted by di-, tri- or tetra-alkylbenzene is preferably used as such an alkylbenzene. These alkylbenzenes may be used singly or in combination thereof. An alkylbenzene having a short alkyl group as a side chain is desirable in view of the yield of anisotropic pitch. On the contrary, an alkylbenzene having a long side chain is undesirable in that the alkyl side chain undergoes thermal decomposition at the stage of thermal modification to produce a product, the structure of which is different from the pitch. Accordingly, as the alkyl group there is preferably used a methyl or an ethyl group. Examples of such an alkylbenzene include xylene and a $C_{9-10}$ alkylbenzene which is obtained in a large amount by a catalytic reforming reaction in the petroleum industry.

As the condensed aromatic compounds with two to four fused rings there may be used a chemical product such as naphthalene, anthracene, phenanthrene, and naphthacene or a fraction having a boiling point of 500° C. or below (in terms of normal pressure) from fluid catalytic cracking of residual oil or anthracene oil. Unlike the above-mentioned coal tar pitch or fluid catalytic cracking residual oil containing fine particles constituting the ash components, these materials essentially do not contain inorganic materials such as free carbon and powdered catalyst. Thus, these materials can be said to be excellent raw materials in this respect. In particular, the above chemical products are more preferable because they do not contain any element of different kind such as sulfur.

Preparation of a mesophase pitch from the thus prepared polymer can be carried out in any known techniques as far as the rate of mesophase portion of the produced pitch is more than 80%, preferably more than 90%, and that the pitch does not substantially contain any infusible substances which deteriorate spinnability. For instance, thermal modification of the polymer is carried out at 350° to 460° C. for 0.5 to 10 hours under an inert atmosphere of nitrogen or argon, or in some cases methane. Then, if necessary, infusible substances which deteriorate spinnability are separated and removed from the thermally modified material by separation process utilizing gravity force or centrifugal force up to 1,000 G at 200° to 300° C., or if preferred by means of filtration. Then, the material from which insoluble substances are removed is subjected to vacuum distillation to remove a light fraction and to transform it to mesophase pitch at 380° to 420° C. under 10 mm Hg or less. Sometimes this step is carried out by heating and using a high inert gas sparging rate.

It is well known that in order to obtain high quality carbon fibers, it is necessary for pitch to have high anisotropy and to align the molecules parallel to the fiber axis at the stage of spinning. Additionally, it is advantageous that the molecule in the direction of the fiber axis is long in order to increase the strength of the fibers.

By way of example, the structure of a polymer obtained by the reaction of the above-mentioned alkylbenzene or the above-mentioned resins with a condensed aromatic compound with two to four fused rings as raw materials in the presence of a protonic acid catalyst mainly is those having armoatic ring of the both compounds bonded together via a methylene group. When the polymer thus prepared is subjected to thermal modification, adjacent aromatic rings form rings via alkyl side chains, thus producing a relatively large number of condensed ring structures. Surprisingly, it was found that raw threads obtained by spinning the present pitch have a remarkably higher strength than that spun from known mesophase pitch. That is, the strength of the present raw threads reaches 800 to 1,200 kg/cm$^2$. It is believed that the high strength is attributable to the specified molecular structure of the present invention. However, the details are unknown.

The present invention will be further illustrated in the following examples, but the present invention should not be construed as being limited thereto.

EXAMPLE 1

120 g of a commercially available mesitylene formalin resin (Nikanol M ® prepared by Mitsubishi Gas Chemical Industries Ltd.; oxygen content is 11.5 wt%), 90 g of anthracene, and 20 g of paratoluenesulfonic acid were placed in a flask equipped with agitating blades and a reflux condenser. These materials were allowed to react with each other at a temperature of 110° C. for 2 hours. After the reaction was finished, the reaction mixture was diluted with 100 g of benzene. The reaction mixture was then washed with pure water until the aqueous phase became neutral. The solution was distilled under reduced pressure (200° C./100 mm Hg) to remove unreacted materials therefrom. As a result, 170 g of a polymer was obtained. The oxygen content of the polymer thus obtained was 0.6% by weight.

60 g of the polymer thus obtained was allowed to react under reflux at a temperature of 400° C. in an inert gas atmosphere of nitrogen for 5 hours. The polymer thus reacted was distilled under reduced pressure (400° C./10 mm Hg) and converted to a mesophase pitch. As a result, 27.0 g of a pitch was obtained. The pitch thus obtained had an optical anisotropy of 85%, a softening point of 270° C., a toluene-insoluble content of 78.3% by weight, and a quinoline-insoluble content of 22.6% by weight.

When the pitch was melt-spun through spinning nozzles having a diameter of 0.3 mm at a spinning temperature of 350° C., pitch fibers of 13 μm diameter were smoothly prepared without thread cutting. The pitch fibers (raw thread) had a tensile strength of 1,050 kg/cm$^2$. The pitch fibers were made infusible by gradually raising the temperature finally to 300° C. in an air atmosphere. The pitch fibers thus infusibilized were then carbonized by calcining up to 1,000° C. in an inert atmosphere. The resulting carbon fibers had a tensile strength of 16.6 ton/cm$^2$ and a modulus of elasticity of 140 ton/cm$^2$.

EXAMPLE 2

110 g of a xylene formalin resin (oxygen content is 8.8 wt%), 90 g of anthracene, and 20 g of paratoluenesulfonic acid were placed in a flask equipped with agitating blades and a reflux condenser. These maerials were allowed to react with each other at a temperature of 105° C. for 3 hours. After the reaction was finished, the reaction mixture was diluted with 100 g of benzene, then washed with pure water until the aqueous phase became neutral. The solution was distilled under reduced pressure (200° C./100 mm Hg) to remove unreacted materials therefrom. As a result, 150 g of a polymer was obtained. The oxygen content of the polymer thus obtained was 0.5% by weight.

60 g of the polymer thus obtained was allowed to react under reflux at a temperature of 410° C. in an inert gas atmosphere of nitrogen for 3 hours. The polymer thus reacted was then heated at a temperature of 400° C. while bubbling nitrogen through the reaction mixture at a rate of 400 cc/min. so that light fractions were removed therefrom. As a result, 24.0 g of a pitch was obtained. The pitch thus obtained has an optical anisotropy of 90%, a softening point of 280° C., a toluene-insoluble content of 80.3% by weight, and a quinoline-insoluble content of 27.3% by weight.

When the pitch was melt-spun through spinning nozzles having a diameter of 0.3 mm at a spinning temperature of 355° C., pitch fibers of 14 μm diameter were smoothly prepared without thread cutting. The pitch fibers (raw thread) had a tensile strength of 1,000 kg/cm$^2$. The pitch fibers were made infusible by gradually raising the temperature finally to 300° C. in an air atmosphere. The pitch fibers thus infusibilized were then carbonized by calcining up to 1,000° C. in an inert atmosphere. The resulting carbon fibers had a tensile strength of 17.2 ton/cm$^2$ and a modulus of elasticity of 1,450 ton/cm$^2$.

COMPARATIVE EXAMPLE 1

A heavy oil having a boiling point of 400° C. extracted from fluid catalytic cracking of a residual oil was used as a raw material. 60 g of the heavy oil was allowed to react under reflux at a temperature of 420° C. in an inert gas atmosphere of nitrogen for 7 hours. The heavy oil thus reacted was converted to a mesophase pitch while distilled under reduced pressure (400° C./10 mm Hg) to remove light fraction therefrom. As a result, 15.2 g of a pitch was obtained. The pitch thus obtained has an optical anisotropy of 90%, a softening point of 280° C., and H/C of 0.58. When the pitch was melt-spun through spinning nozzles having a diameter of 0.5 mm at a temperature of 350° C., pitch fibers of 13 μm diameter were obtained without thread cutting. The pitch fibers (raw thread) had a tensile strength of 410 kg/cm$^2$. The pitch fibers were made infusible by gradually raising the temperature finally to 300° C. The pitch fibers thus infusibilized were carbonized by calcining up to 1,000° C. in an inert atmosphere. The resulting carbon fibers had a tensile strength of 16.3 ton/cm$^2$ and a modulus of elasticity of 1,350 ton/cm$^2$.

As is apparent from the foregoing description, the optically anisotropic pitch of the present invention can provide a rather high raw thread strength when spun as cpmpared to known pitch. The optically anisotropic pitch can also be spun in an easy and stable manner. Furthermore, the optically anisotropic pitch has less ash content or other impurities which cause fiber defects than known pitches. Thus, the present pitch has excellent properties as raw pitch for carbon fibers, providing carbon fibers having a high tensile strength.

While the invention has been described in detail and with reference to specific embodiments thereof, it will be apparent to one skilled in the art that various changes and modifications can be made therein without departing from the spirit and scope thereof.

We claim:

1. An optically anisotropic pitch, wherein said pitch is preared by singly using as a starting material a polymer which has a structure of an alkylbenzene and a condensed aromatic compound with two to four fused rings bonded together via a methylene group, and by subjecting said starting material to thermal modification at 350° C. to 460° C. for 0.5 to 10 hours and then removing a light fraction.

2. An optically anisotropic pitch as claimed in claim 1, wherein the optical anisotropy is 80% or more.

3. An optically anisotropic pitch is claimed in claim 1, wherein said alkylbenzene is xylene, trimethylbenzene, or tetramethylbenzene.

4. An optically anisotropic pitch as claimed in claim 1, wherein said condensed aromatic compound with two to four fused rings is naphthalene, anthracene, phenanthrene, or naphthacene.

5. An optically anisotropic pitch as claimed in claim 1, wherein said starting material is a polymer obtained by the reaction of a xylene formalin resin and a condensed aromatic compound with two to four fused rings as raw materials in the presence of a protonic acid catalyst.

6. An optically anisotropic pitch as claimed in claim 1, wherein said starting material is a polymer obtained by the reaction of a mesitylene formalin resin and a condensed aromatic compound with two to four fused rings as raw materials in the presence of a protonic acid catalyst.

7. An optically anisotropic pitch as claimed in claim 1, wherein said starting material is a polymer obtained by the reaction of an alkylbenzene, a condensed aromatic compound with two to four fused rings, and formaldehyde as raw materials in the presence of a protonic acid catalyst.

* * * * *